US009882324B2

(12) United States Patent
Shi et al.

(10) Patent No.: US 9,882,324 B2
(45) Date of Patent: Jan. 30, 2018

(54) ELECTRICAL CONNECTOR ASSEMBLY HAVING IDENTICAL MATABLE CONNECTORS

(71) Applicant: Tyco Electronics (Shanghai) Co. Ltd., Shanghai (CN)

(72) Inventors: Ming Shi, Shanghai (CN); Xiang Xu, Shanghai (CN); Xiaozhi Fu, Shanghai (CN); Yuquan Chen, Shanghai (CN); Yong Yang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/091,907

(22) Filed: Apr. 6, 2016

(65) Prior Publication Data

US 2016/0301168 A1 Oct. 13, 2016

(30) Foreign Application Priority Data

Apr. 7, 2015 (CN) ..... 2015 2 0204389 U

(51) Int. Cl.

| | |
|---|---|
| ***H01R 24/84*** | (2011.01) |
| ***H01R 4/48*** | (2006.01) |
| *H01R 13/28* | (2006.01) |
| *H01R 13/627* | (2006.01) |
| *H01R 24/28* | (2011.01) |

(52) U.S. Cl.

CPC ..... *H01R 24/84* (2013.01); *H01R 4/4836* (2013.01); *H01R 13/28* (2013.01); *H01R 13/6272* (2013.01); *H01R 24/28* (2013.01)

(58) Field of Classification Search

CPC ..... H01R 24/84; H01R 13/28; H01R 13/27; H01R 11/09; H01R 24/28; H01R 4/4836; H01R 13/6272

USPC ..... 439/282, 660, 352, 686, 687, 696, 731, 439/594, 701, 712, 715, 292

See application file for complete search history.

(56) References Cited

U.S. PATENT DOCUMENTS

| | | | | | |
|---|---|---|---|---|---|
| 3,676,833 | A * | 7/1972 | Johnson | H01R 13/28 | 439/295 |
| 3,794,957 | A * | 2/1974 | Winkler | H01R 13/28 | 439/170 |
| 4,335,931 | A * | 6/1982 | Kinnear | H01R 13/28 | 439/295 |
| 4,469,393 | A * | 9/1984 | Chewning, Jr. | H01R 13/514 | 439/717 |
| 4,963,102 | A * | 10/1990 | Gettig | H01R 13/28 | 439/291 |
| 4,995,830 | A * | 2/1991 | Eckhaus | H01R 4/2491 | 439/409 |
| 5,414,507 | A * | 5/1995 | Herman | G01L 9/0039 | 250/227.21 |
| 6,074,238 | A * | 6/2000 | DeRoss | H01R 12/675 | 439/409 |
| 6,074,242 | A * | 6/2000 | Stefaniu | H01R 4/4827 | 439/441 |
| 6,089,898 | A * | 7/2000 | Lincoln, III | H01R 13/6272 | 439/357 |

(Continued)

*Primary Examiner* — Harshad C Patel
(74) *Attorney, Agent, or Firm* — Barley Snyder

(57) ABSTRACT

An electrical connector is disclosed. The electrical connector has an insulation body formed with a receiving slot and a terminal disposed in the receiving slot. The electrical connector is matable with an identical electrical connector.

25 Claims, 11 Drawing Sheets

(56) References Cited

U.S. PATENT DOCUMENTS

| | | | | |
|---|---|---|---|---|
| 6,193,550 | B1 * | 2/2001 | Yamashita | H01R 13/514 439/594 |
| 6,332,813 | B1 * | 12/2001 | Okabe | H01R 13/514 439/541.5 |
| 6,350,159 | B1 * | 2/2002 | Wu | H01R 13/64 439/358 |
| 6,860,765 | B1 * | 3/2005 | Spink, Jr. | H01R 12/716 439/680 |
| 7,001,194 | B2 * | 2/2006 | Yang | H01R 23/27 439/295 |
| 7,404,744 | B2 * | 7/2008 | Amano | H01R 13/514 439/540.1 |
| 7,628,630 | B2 * | 12/2009 | Chang | H01R 13/28 439/295 |
| 2006/0178029 | A1 * | 8/2006 | Fabian | H01R 23/27 439/284 |
| 2006/0286864 | A1 * | 12/2006 | Bethurum | H01R 4/4818 439/595 |
| 2007/0099480 | A1 * | 5/2007 | Fabian | H01R 13/4367 439/441 |

* cited by examiner

ELECTRICAL CONNECTOR ASSEMBLY HAVING IDENTICAL MATABLE CONNECTORS

CROSS-REFERENCE TO RELATED APPLICATIONS

This application claims the benefit of the filing date under 35 U.S.C. §119(a)-(d) of Chinese Patent Application No. CN201520204389.1 filed on Apr. 7, 2015.

FIELD OF THE INVENTION

The present invention relates to an electrical connector, and more particularly, to an electrical connector for quickly electrically connecting one wire with another wire.

BACKGROUND

In the prior art, in order to quickly form an electrical connection between two wires, a male electrical connector and a female electrical connector are often used and mated with one another. The male electrical connector is different from the female electrical connector in structure. Generally, a front end of the male electrical connector has a protruding plug, and a front end of the female electrical connector has an insertion chamber. When the plug of the male electrical connector is inserted into the insertion chamber of the female electrical connector, a conductive terminal of the male electrical connector will electrically contact with a conductive terminal of the female electrical connector. In this way, it is possible to electrically connect the one conductive wire to the other conductive wire.

An insulation body and conductive terminal of the male electrical connector are structurally different from those of the female electrical connector in the prior art. Thus, it is necessary to separately manufacture the insulation body and conductive terminal of the male electrical connector and the insulation body and conductive terminal of the female electrical connector, which result in an increase in manufacturing cost.

SUMMARY

An object of the invention, among others, is to provide an electrical connector which is able to mate with another electrical connector identical in structure. The disclosed electrical connector has an insulation body including a receiving slot and a terminal disposed in the receiving slot, the electrical connector formed to be matable with an identical electrical connector.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
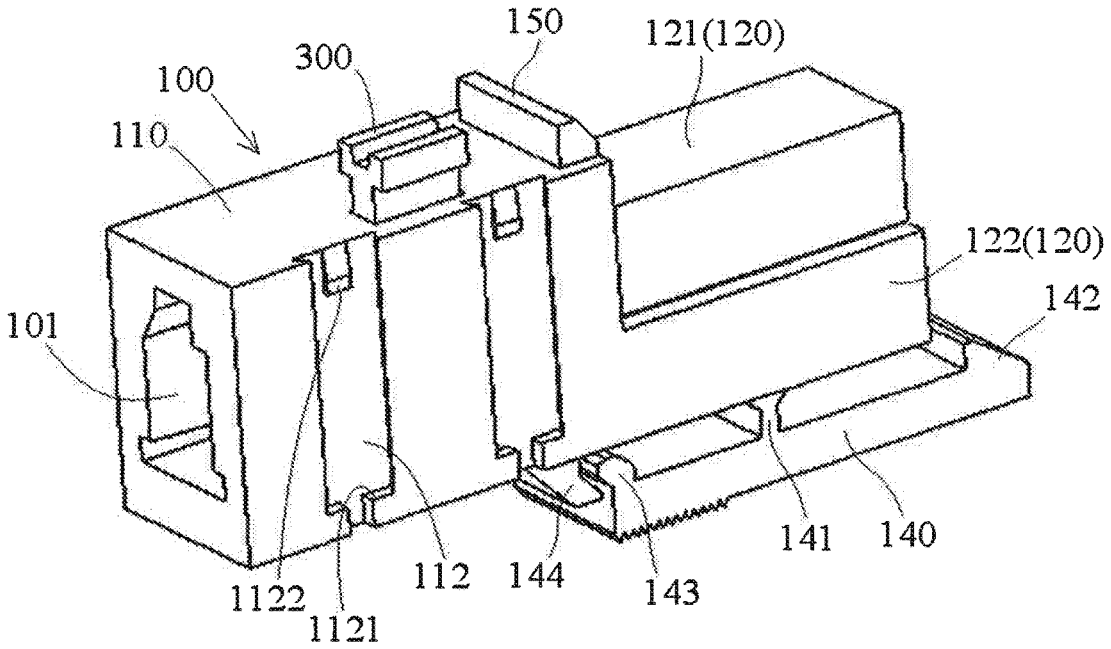
FIG. 1 is a rear perspective view of an electrical connector according to an exemplary embodiment of the disclosure.

Exemplary embodiments of the disclosure will be described hereinafter in detail with reference to the attached drawings. In the description, the same or similar reference numerals refer to the same or similar components. The description of the embodiments of the disclosure hereinafter with reference to the attached drawings is intended to explain the general inventive idea of the disclosure and should not be construed as being limited to the disclosure.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
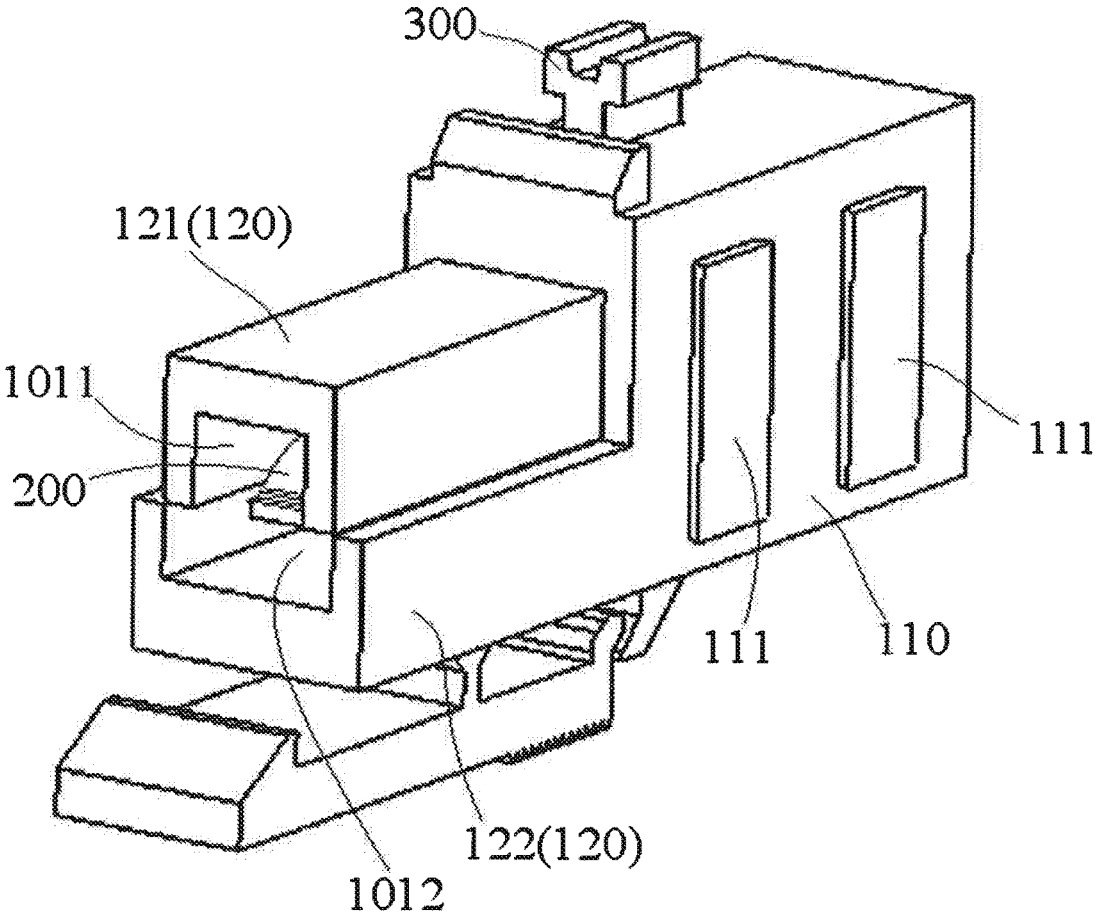
FIG. 2 is a front perspective view of the electrical connector.
Figure 3:
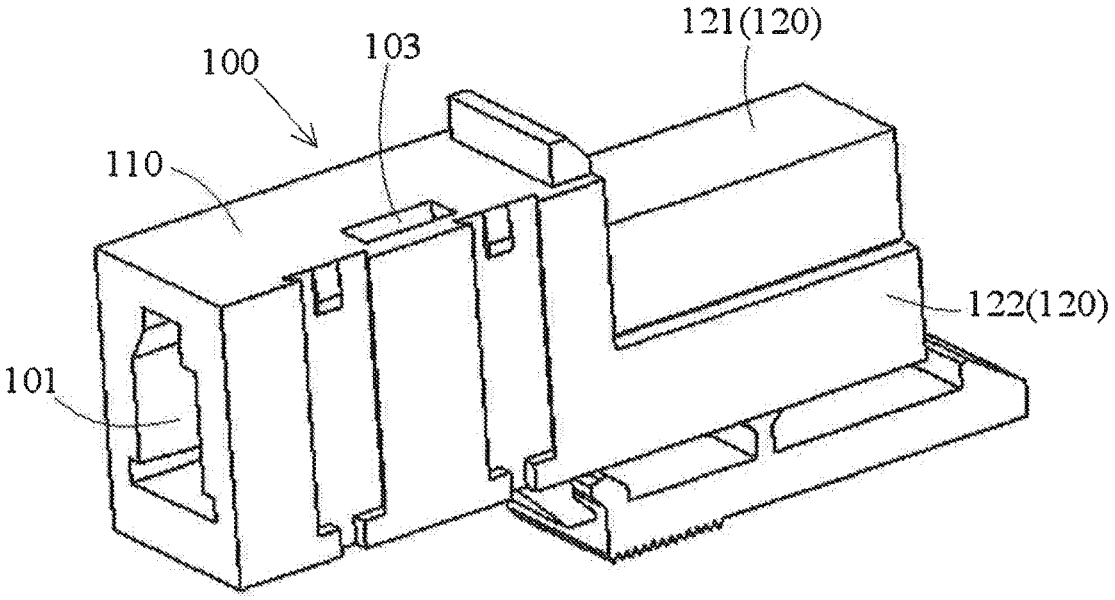
FIG. 3 is a perspective view of an insulation body of the electrical connector of FIGS. 1 and 2.
Figure 9:
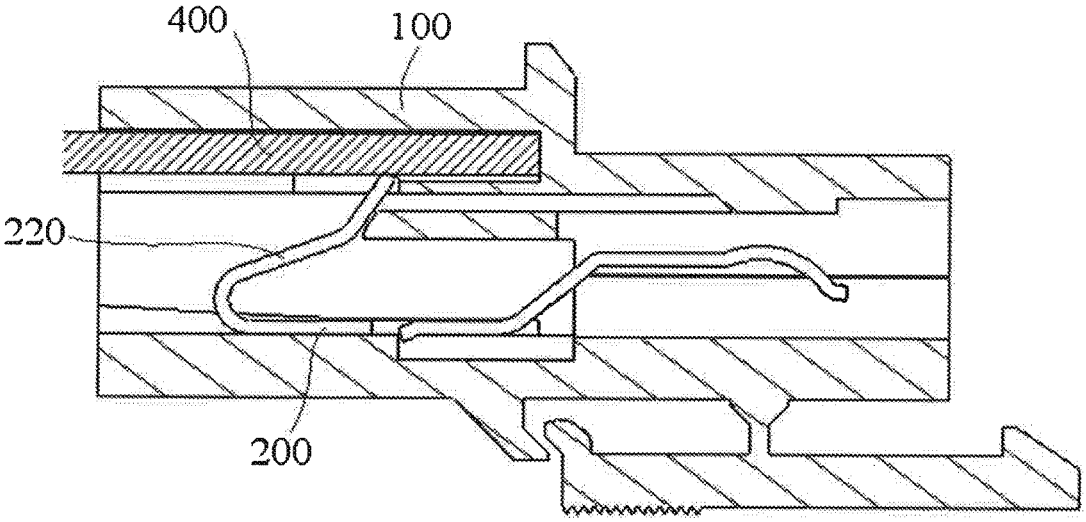
FIG. 9 is a sectional view of the electrical connector shown in FIGS. 1 and 2 and a conductor of an external wire.

The electrical connector according to the invention has an insulation body 100, a terminal 200, a push piece 300, and a conductor wire 400 as shown in FIGS. 1, 2, and 9. The major components of the invention will now be described in greater detail.

Figure 12:
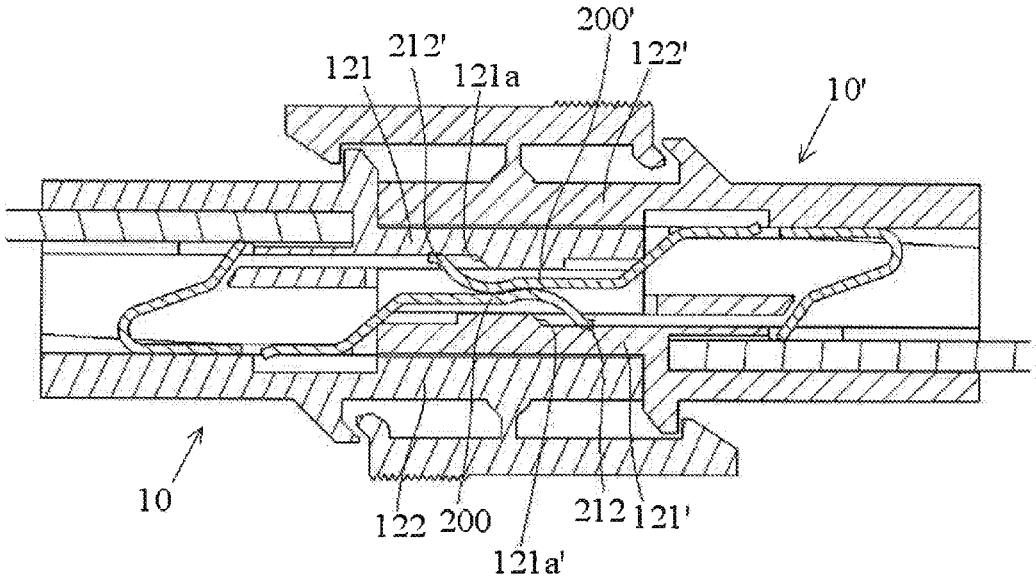
FIG. 12 is a sectional view of the two identical electrical connectors mated with each other shown in FIG. 10.

As shown in FIGS. 1 and 2, the insulation body 100 has a front body 120 and a rear body 110. The front body 120 includes a first front body 121 and a second front body 122 opposite to each other in a vertical direction. In an exemplary embodiment of the disclosure, as shown in FIG. 12, a protrusion 121*a* is formed on an inner wall of the first front body 121. A protrusion 150, as shown in FIG. 1, is formed on a top surface of the insulation body 100 close to the first front body 121.

Figure 6:
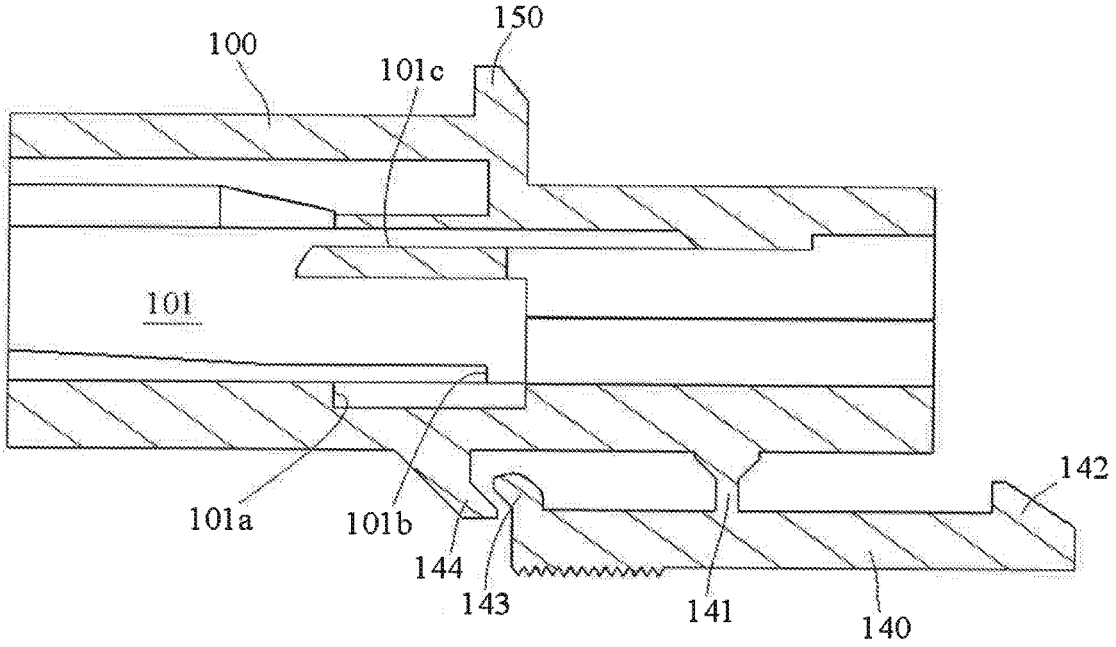
FIG. 6 is a sectional view of the insulation body.
Figure 7:
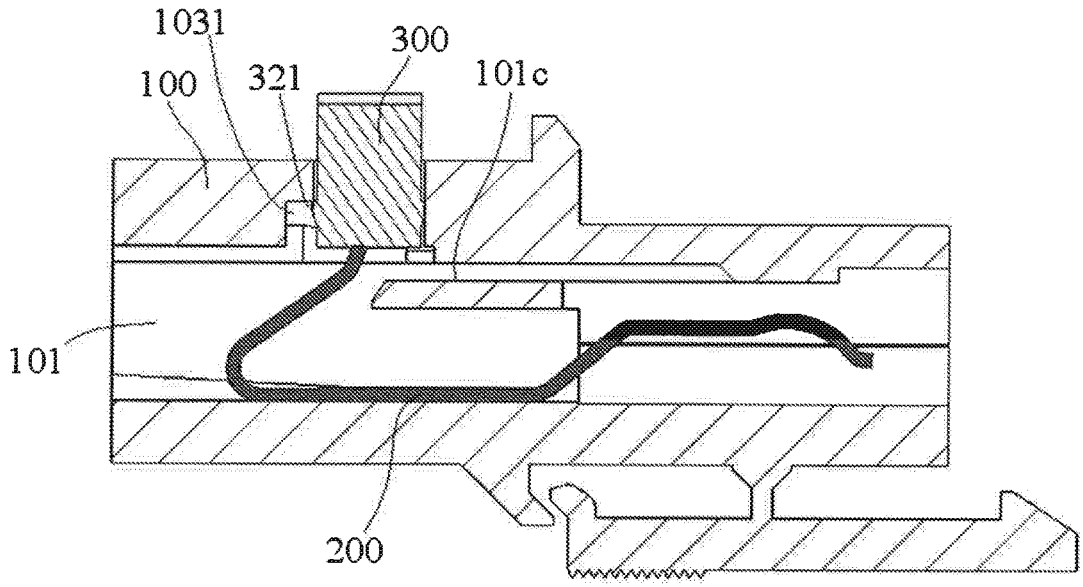
FIG. 7 is a sectional view of the electrical connector shown in FIGS. 1 and 2, wherein the push piece is in an un-pushed state.
Figure 8:
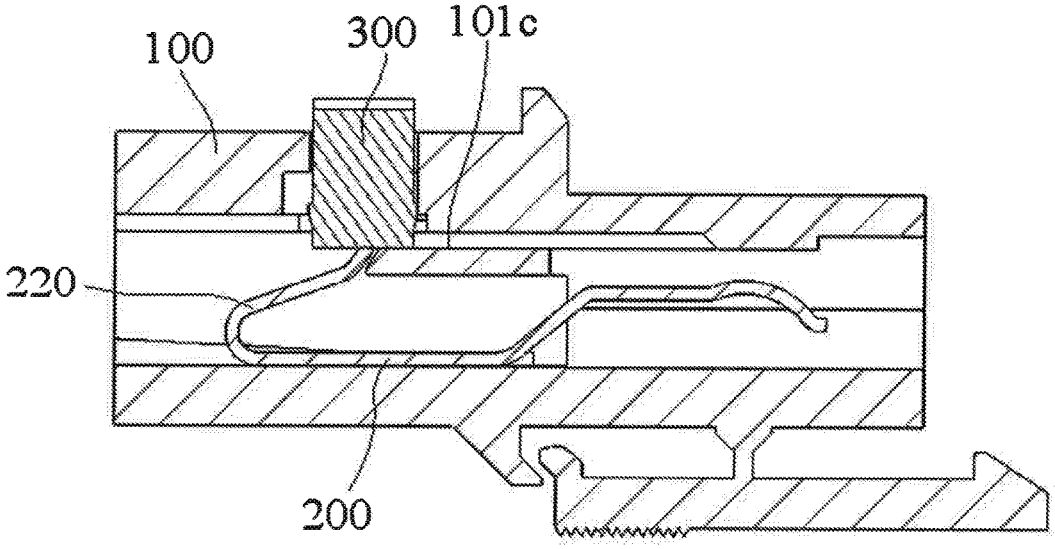
FIG. 8 is a sectional view of the electrical connector shown in FIGS. 1 and 2, wherein the push piece is in a pushed state.

The insulation body 100 also has a receiving slot 101 therein. As shown in FIG. 2, the receiving slot 101 includes a first front receiving slot 1011 formed in the first front body 121, and a second front receiving slot 1012 formed in the second front body 122 communicating with the first front receiving slot 1011. As shown in FIGS. 6, 7 and 8, in the illustrated embodiment, the receiving slot 101 is further formed with a second stop wall 101*c*, which is formed as a cantilever and protrudes from an inner wall of the receiving slot 101. The insulation body 100, as shown in FIGS. 3-5 and 7-8, also has an insertion hole 103 communicating with the receiving slot 101; as shown in FIG. 7, in the illustrated embodiment, a recess 1031 is formed in an inner wall of the insertion hole 103. As shown in FIG. 6, a groove 101*a* is formed in the inner wall of the insulation body 100, and stop surfaces 101*b* are formed on the inner wall of the receiving slot 101.

Figure 10:
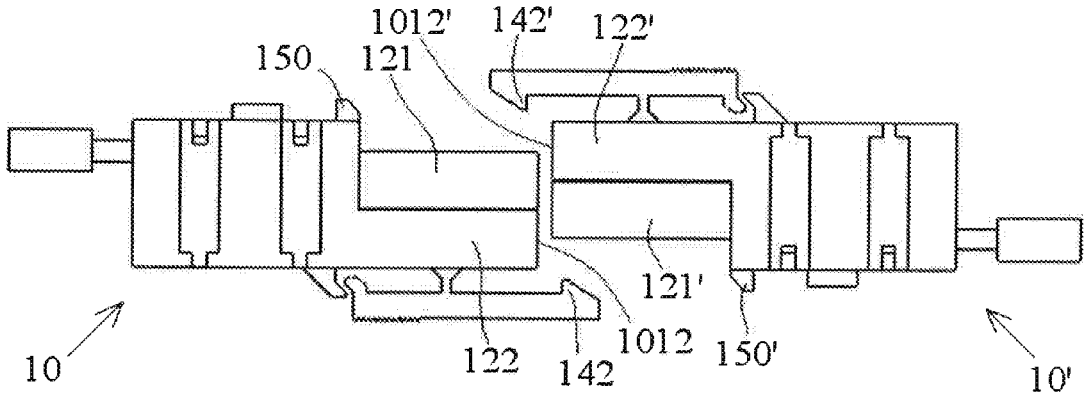
FIG. 10 is a side view of two identical electrical connectors shown in FIGS. 1 and 2.
Figure 11:
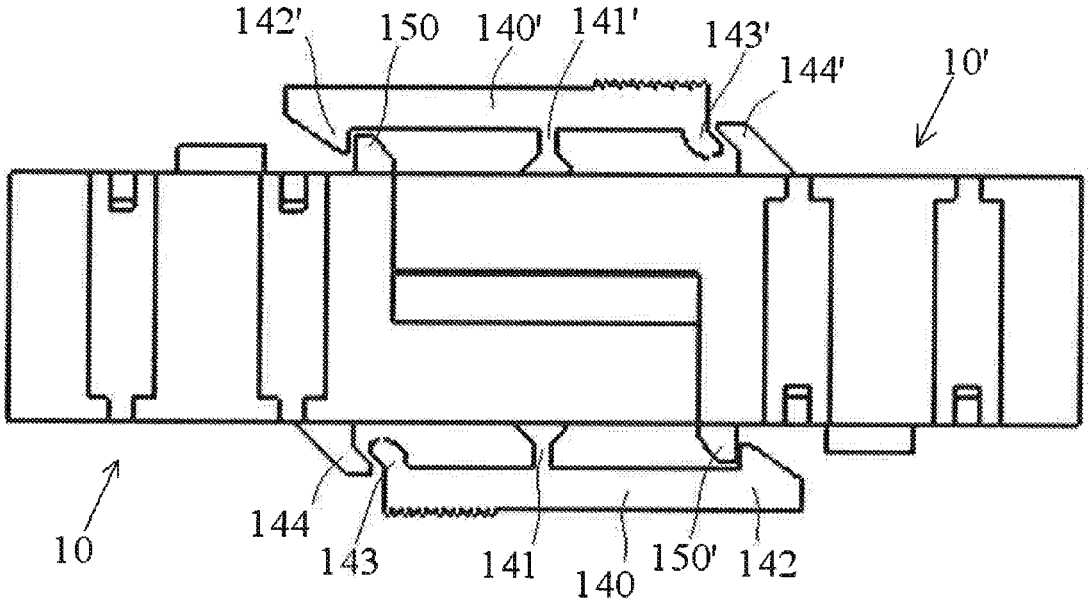
FIG. 11 is a side view of mating the two identical electrical connectors shown in FIG. 10.

As shown in FIGS. 1, 10 and 11, in an exemplary embodiment of the disclosure, an elastic arm 140 is formed on a bottom surface of the insulation body 100 away from the first front body 121, and one end of the elastic arm 140 extends beyond a front end surface of the insulation body 100 and formed with a hook 142. A connection portion 141 protruding inwardly is formed at a middle of the elastic arm 140, and the connection portion 141 is connected to the bottom surface of the insulation body 100 so that the elastic arm 140 is able to move upwardly and downwardly with the connection portion 141 as a fulcrum. A tail 143 protruding upwardly is formed at the other end of the elastic arm 140, and an elastic press piece 144 is formed on the bottom surface of the insulation body 100. The elastic press piece 144 is adapted to be pressed onto the tail 143 of the elastic arm 140.

As shown in FIGS. 1, 2, 13 and 14, in an exemplary embodiment of the disclosure, a dovetail protrusion 111 is formed on one of side surfaces of the insulation body 100, and a dovetail recess 112 is formed in the other side surface of the insulation body 100. A stop wall 1121 is formed at one end of the dovetail recess 112, and an elastic protrusion 1122 is formed on a bottom surface of the other end of the dovetail recess 112, as shown in FIG. 1.

Figure 4:
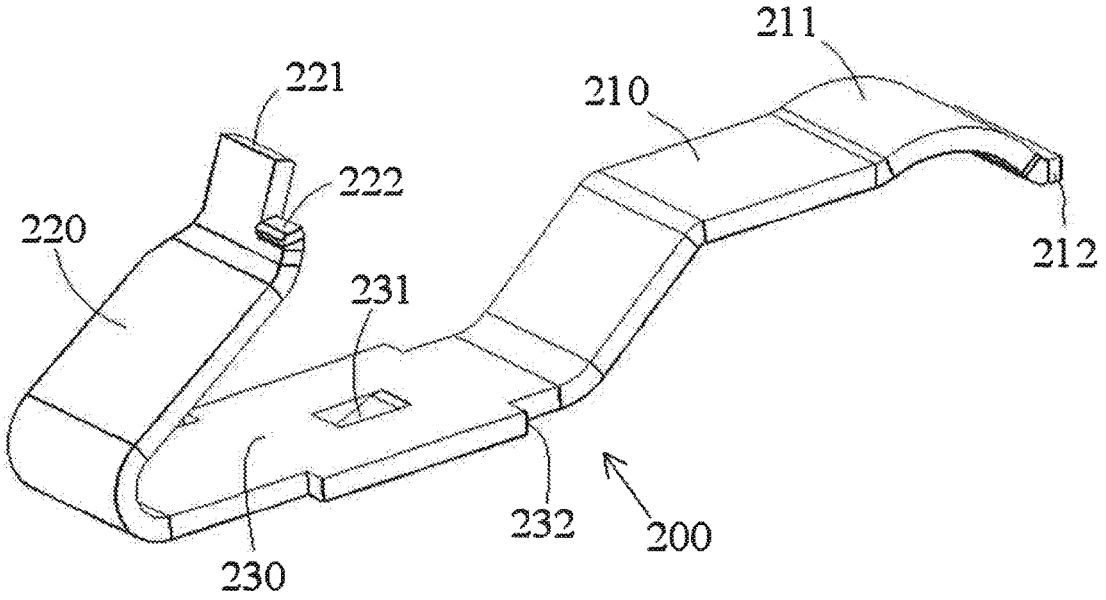
FIG. 4 is a perspective view of a terminal of the electrical connector of FIGS. 1 and 2.

As shown in FIG. 4, in the illustrated embodiment, the terminal 200 includes a fixing portion 230, a first elastic arm 210 extending from the fixing portion 230, and a first electrical contact portion 211 having an end 212 formed at an end of the first elastic arm 210. The terminal 200 further includes a second elastic arm 220 extending rearwardly from the fixing portion 230. As shown in FIG. 4, a platform portion 222 which is lower than an end surface of an end 221 of the second elastic arm 220 is formed on one side of the end 221. An elastic protrusion 231 is formed on the fixing portion 230 of the terminal 200, and stop portions 232 protruding outwardly are formed on either side of the fixing portion 230 of the terminal 200.

Figure 5:
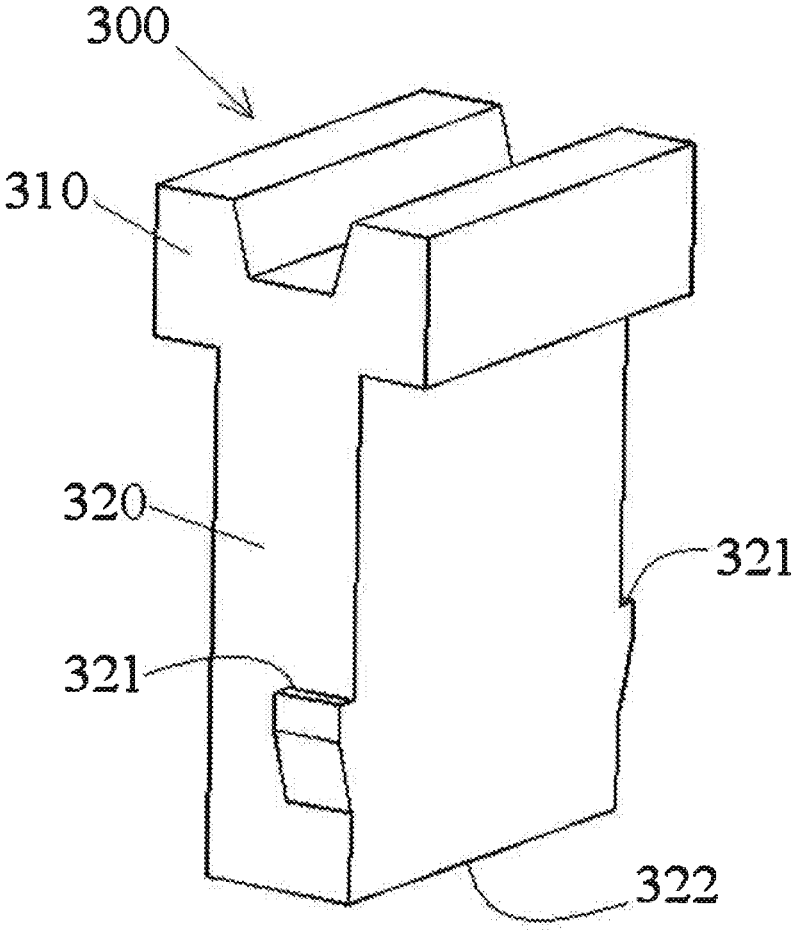
FIG. 5 is a perspective view of a push piece of the electrical connector of FIGS. 1 and 2.

The push piece 300 has a base 310 and rectangular bar portion 320 extending from the base 310, as shown in FIG. 5. A tab 321 is formed on two opposing side surfaces of the bar portion 320. The bar portion 320 has a bottom surface 322 positioned on an end of the bar portion 320 opposite the base 310.

As shown in FIG. 9, conductor 400 is the electrical conducting portion of an external wire. The external wire having conductor 400 may be any external wire known to those with ordinary skill in the art that is capable of conducting.

The connections forming the electrical connector will now be described in greater detail.

The terminal 200 is held in the receiving slot 101 of the insulation body 100. The elastic protrusion 231 of the terminal 200 is adapted to be snap-fitted into the groove 101*a* when the terminal 200 is mounted in the receiving slot 101 of the insulation body 200, as shown in FIG. 9. When the terminal 200 is completely inserted into the receiving slot 101, the stop portions 232 are abutted against the stop surfaces 101*b*, respectively, to prevent a further insertion of the terminal 200. The terminal 200 is positioned, as shown in FIGS. 2 and 9, such that the first elastic arm 210 extends into the receiving slot 101.

The push piece 300, as shown in FIGS. 7 and 8, is slidably mounted in the insertion hole 103. The bottom surface 322 is adapted to be pressed against the platform portion 222 of the second elastic arm 220 to facilitate an insertion or draw of the conductor 400. As shown in FIGS. 5, 7 and 8, in the illustrated embodiment, the base 310 is located outside of the insertion hole 103 and the bar portion 320 is inserted into the insertion hole 103.

The use of the electrical connector will now be described in greater detail.

In an exemplary embodiment of the disclosure, the first front body 121 is formed to be matable with the second front receiving slot 1012. As shown in FIGS. 1 to 3 and 10 to 12, in an exemplary embodiment of the disclosure, the first front body 121 of the electrical connector 10 shown in FIGS. 1 and 2 is adapted to be inserted into a second front receiving slot 1012' of a second front body 122' of the other electrical connector 10', and a first front body 121' of the other electrical connector 10' is adapted to be inserted into the second front receiving slot 1012 of the second front body 122 of the electrical connector 10, so that the electrical connector 10 and the other electrical connector 10' are mated with each other. As shown in FIG. 12, when the two identical electrical connectors 10, 10' are mated with each other, the first electrical contact portion 211 of the one electrical connector 10 is electrically contacted with a first electrical contact portion 211' of the other electrical connector 10'.

As illustrated in FIGS. 10 and 11, when the one electrical connector 10 of the two identical electrical connectors 10, 10' is mated with the other electrical connector 10', the hook 142 of the one electrical connector 10 is engaged with a protrusion 150' of the other electrical connector 10', and a hook 142' of the other electrical connector 10' is engaged with the protrusion 150 of the one electrical connector 10, so that the one electrical connector 10 and the other electrical connector 10' are locked together. In this way, it is possible to prevent an accidental disconnection of the two electrical connectors 10, 10' mated with each other under an external force.

As shown in FIG. 12, when the one electrical connector 10 and the other electrical connector 10' are mated with each other, the end 212 of the first electrical contact portion 211 of the one electrical connector 10 is interference-fitted with a protrusion 121*a'* of the other electrical connector 10', and an end 212' of the first electrical contact portion 211' of the other electrical connector 10' is interference-fitted with the protrusion 121*a* of the one electrical connector 10, thereby preventing the one electrical connector 10 and the other electrical connector 10' mated with each other from being accidently disengaged under an external force.

After the two identical electrical connectors 10, 10' are mated with each other, it is possible to disengage the hook 142 of the one electrical connector 10 from the protrusion 150' of the other electrical connector 10' through pressing the tail 143 of the elastic arm 140 by the press piece 144 of the one electrical connector 10. Similarly, as shown in FIG. 11, after the two identical electrical connectors 10, 10' are mated with each other, it is possible to disengage the hook 142' of the other electrical connector 10' from the protrusion 150 of the one electrical connector 10 through pressing a tail 143' of an elastic arm 140' by a press piece 144' of the other electrical connector 10'.

In the embodiment described above, as shown in FIGS. 1, 7 and 9, when it is necessary to insert the conductor 400 of the external wire into the electrical connector, firstly, the second elastic arm 220 of the terminal 200 is pushed downwardly by applying an press force on the push piece 300 so that the end 221 of the second elastic arm 220 is driven to move downwardly. The second stop wall 101*c*, as shown in FIG. 8, restricts a maximum movement amount of the push piece 300 to prevent the second elastic arm 220 from being excessively pressed by the press force applied on the push piece 300. The conductor 400 of the external wire is then inserted into the receiving slot 101 of the electrical connector, and finally, the press force applied on the push piece 300 is removed to release the second elastic arm 220 of the terminal 200. In this way, the end 221 of the second elastic arm 220 of the terminal 200 will press the conductor 400 of the external wire against the inner wall of the receiving slot 101 so as to realize the electrical connection with the conductor 400 of the external wire.

In the embodiments as described above, as shown in FIGS. 1, 7 and 9, when it is necessary to draw the conductor 400 of the external wire out from the electrical connector, the second elastic arm 220 of the terminal 200 is firstly pushed downwardly by the push piece 300 so that the end 221 of the second elastic arm 220 is driven to move downwardly, then the conductor 400 of the external wire is drawn out from the receiving slot 101 of the electrical connector, and finally, the push piece 300 is released. The tab 321 of the push piece 300 is abutted against a first stop wall of the recess 1031 while being pushed by the second elastic arm 220 to prevent the push piece 300 from being disengaged from the insertion hole 103. In this way, it is possible to allow the conductor 400 of the external wire to be inserted in and drawn out from the electrical connector through the push piece 300.

Figure 13:
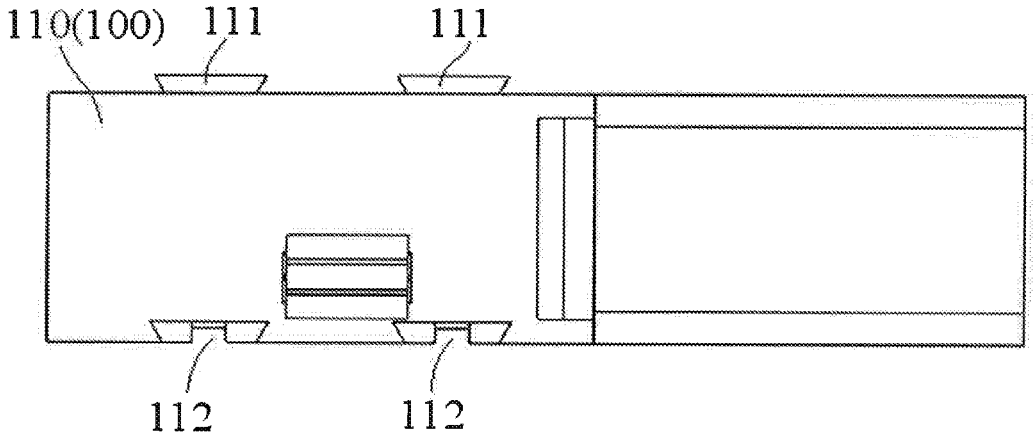
FIG. 13 is a top view of the electrical connector shown in FIG. 1.
Figure 14:
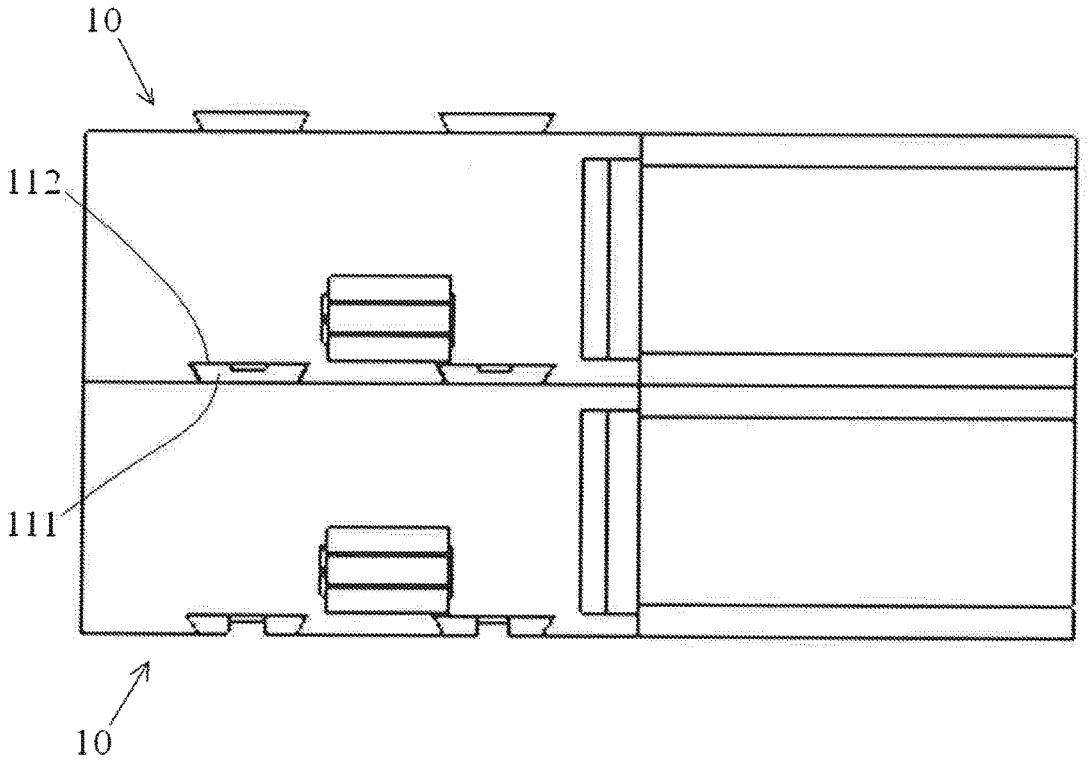
FIG. 14 is a tope view of a plurality of electrical connectors shown in FIG. 1.

As shown in FIGS. 13 and 14, the dovetail protrusion 111 of the electrical connector 10 is mated with and adapted to be fitted into the dovetail recess 112 of the other electrical connector 10'. In this way, it is possible to assemble a plurality of identical electrical connectors side by side together. When the dovetail protrusion 111 of the electrical connector is fitted into the dovetail recess 112 of the other electrical connector, the dovetail protrusion 111 of the electrical connector 10 is defined between the stop wall 1121 and the elastic protrusion 1122 of the other electrical connector 10' so as to prevent a disengagement of the dovetail protrusion 111 from the dovetail recess 112.

Advantageously, in various exemplary embodiments of the disclosure described above, the same electrical connector has features of both male and female electrical connectors, thus, it is possible to connect the two identical electrical connectors with each other. Therefore, according to the invention, it is unnecessary to manufacture male and female electrical connectors different from each other in structure, thereby reducing the manufacturing cost of the electrical connector.

What is claimed is:

1. An electrical connector assembly, comprising:

a first electrical connector having an insulation body formed with a receiving slot, the insulation body having a front body, including a first front body and a second front body opposite to each other in a vertical direction, and a rear body, the receiving slot having a first front receiving slot formed in the first front body and a second front receiving slot formed in the second front body, and a terminal disposed in the receiving slot, the terminal having a fixing portion in the rear body, a first elastic arm extending from the fixing portion to the receiving slot, the first elastic arm including a first electrical contact portion formed at an end of the first elastic arm, and a second elastic arm extending rearwardly from the fixing portion, an end of the second elastic arm arranged to face an inner wall of the receiving slot and pressing a conductor of an external wire against the inner wall of the receiving slot to form an electrical connection with the conductor, a platform portion formed on one side of the end of the second elastic arm lower than a surface of the end; and a second electrical connector identical to the first electrical connector and matable with the first electrical connector, the first front body of the first electrical connector matable with a second front receiving slot of the second electrical connector and a first front body of the second electrical connector matable with the second front receiving slot of the first electrical connector.

2. The electrical connector assembly of claim 1, wherein the first electrical contact portion of the first electrical connector electrically contacts a first electrical contact portion of the second electrical connector when the first and second electrical connectors are in a mating position.

3. The electrical connector assembly of claim 2, wherein an elastic arm is formed on a bottom surface of the insulation body away from the first front body, one end of the elastic arm formed with a hook and extending beyond a front end surface of the insulation body.

4. The electrical connector assembly of claim 3, wherein a protrusion is formed on a top surface of the insulation body.

5. The electrical connector assembly of claim 4, wherein, in a mating position of the first and second electrical connectors, the hook of the first electrical connector engages a protrusion of the second electrical connector, and a hook of the second electrical connector engages the protrusion of the first electrical connector.

6. The electrical connector assembly of claim 5, wherein a connection portion connects a middle of the elastic arm to the bottom surface of the insulation body.

7. The electrical connector assembly of claim 6, wherein the elastic arm is pivotable about the connection portion.

8. The electrical connector assembly of claim 7, wherein a tail is formed at the end of the elastic arm opposite the hook, and an elastic press piece is formed on the bottom surface of the insulation body and adapted to be pressed onto the tail to disengage the hook from the protrusion.

9. The electrical connector assembly of claim 1, wherein the insulation body has an insertion hole communicating with the receiving slot.

10. The electrical connector assembly of claim 9, wherein a push piece is slidably mounted in the insertion hole.

11. The electrical connector assembly of claim 10, wherein the push piece contacts and deforms the platform portion to facilitate an insertion or draw of the conductor.

12. The electrical connector assembly of claim 11, wherein the push piece has a tab.

13. The electrical connector assembly of claim 12, wherein the push piece is slidable between a position in which the tab abuts a first stop wall of a recess in the insertion hole, and a position in which the push piece abuts a second stop wall of the receiving slot.

14. The electrical connector assembly of claim 13, wherein the push piece has a base positioned outside of the insertion hole and a bar portion positioned in the insertion hole, the tab formed on a side surface of the bar portion.

15. The electrical connector assembly of claim 14, wherein a protrusion is formed on an inner wall of the first front body.

16. The electrical connector assembly of claim 15, wherein, in a mating position of the first and second electrical connectors, the end of the first electrical contact portion of the first electrical connector is interference-fit with the protrusion of the second electrical connector, and an end of a first electrical contact portion of the second electrical connector is interference-fit with the protrusion of the first electrical connector.

17. The electrical connector assembly of claim 16, wherein an elastic protrusion is formed on the fixing portion of the terminal adapted to be snap-fit into a groove of the inner wall of the insulation body.

18. The electrical connector assembly of claim 17, wherein stop portions protruding outwardly on either side of the fixing portion abut stop surfaces on the inner wall of the insulation body.

19. The electrical connector assembly of claim 1, wherein a dovetail protrusion is formed on one side surface of the insulation body and a dovetail recess is formed on an opposite side surface of the insulation body.

20. The electrical connector assembly of claim 19, wherein the dovetail protrusion of the first electrical connector is matable with a dovetail recess of the second electrical connector.

21. The electrical connector assembly of claim 20, wherein the dovetail recess has a stop wall formed at one end and an elastic tab formed on a bottom surface of an opposite end.

22. The electrical connector assembly of claim 21, wherein the dovetail protrusion of the first electrical connector is held between the stop wall and the elastic tab.

23. An electrical connector assembly, comprising:

a first electrical connector having an insulation body formed with a receiving slot, the insulation body having a front body including a first front body and a second front body opposite to each other in a vertical direction, the receiving slot having a first front receiving slot formed in the first front body and a second front receiving slot formed in the second front body, a rear body, an elastic arm formed on a bottom surface of the insulation body away from the first front body, one end of the elastic arm formed with a hook and extending beyond a front end surface of the insulation body, a tail formed at the end of the elastic arm opposite the hook, a connection portion connecting a middle of the elastic arm to the bottom surface of the insulation body, the elastic arm pivotable about the connection portion, an elastic press piece formed on the bottom surface of the insulation body, and a protrusion formed on a top surface of the insulation body, and a terminal disposed in the receiving slot, the terminal having a fixing portion in the rear body and a first elastic arm extending from the fixing portion to the receiving slot, the first elastic arm including a first electrical contact portion formed at an end of the first elastic arm; and a second electrical connector identical to the first electrical connector and matable with the first electrical connector in a mating position, in the mating position the first front body of the first electrical connector mates with a second front receiving slot of the second electrical connector and a first front body of the second electrical connector mates with the second front receiving slot of the first electrical connector, the first electrical contact portion of the first electrical connector electrically contacts a first electrical contact portion of the second electrical connector, and the hook of the first electrical connector engages a protrusion of the second electrical connector, and a hook of the second electrical connector engages the protrusion of the first electrical connector, the elastic press piece adapted to be pressed onto the tail to disengage the hook from the protrusion.

24. An electrical connector assembly, comprising:

a first electrical connector having an insulation body formed with a receiving slot, the insulation body having a front body including a first front body and a second front body opposite to each other in a vertical direction, the receiving slot having a first front receiving slot formed in the first front body and a second front receiving slot formed in the second front body, a rear body, a dovetail protrusion formed on one side surface of the insulation body, and a dovetail recess formed on an opposite side surface of the insulation body, the dovetail recess having a stop wall formed at one end and an elastic tab formed on a bottom surface of an opposite end, and a terminal disposed in the receiving slot, the terminal having a fixing portion in the rear body and a first elastic arm extending from the fixing portion to the receiving slot, the first elastic arm including a first electrical contact portion formed at an end of the first elastic arm; and a second electrical connector identical to the first electrical connector and matable with the first electrical connector, the first front body of the first electrical connector matable with a second front receiving slot of the second electrical connector and a first front body of the second electrical connector matable with the second front receiving slot of the first electrical connector, the dovetail protrusion of the first electrical connector matable with a dovetail recess of the second electrical connector.

25. The electrical connector assembly of claim 24, wherein the dovetail protrusion of the first electrical connector is held between the stop wall and the elastic tab.

* * * * *